US006482028B2

(12) United States Patent
Kumamoto et al.

(10) Patent No.: US 6,482,028 B2
(45) Date of Patent: Nov. 19, 2002

(54) CABLE CONNECTOR HAVING GOOD SIGNAL TRANSMISSION CHARACTERISTIC

(75) Inventors: Tadashi Kumamoto, Shinagawa (JP); Manabu Shimizu, Shinagawa (JP); Junichi Akama, Shinagawa (JP); Hideo Miyazawa, Shinagawa (JP); Moriyuki Ueno, Shinagawa (JP)

(73) Assignee: Fujitsu Takamisawa Component Limited, Tokyo (JP)

( * ) Notice: Subject to any disclaimer, the term of this patent is extended or adjusted under 35 U.S.C. 154(b) by 0 days.

(21) Appl. No.: 09/915,591

(22) Filed: Jul. 27, 2001

(65) Prior Publication Data

US 2002/0081874 A1 Jun. 27, 2002

(30) Foreign Application Priority Data

Dec. 27, 2000 (JP) ..... 2000-398529

(51) Int. Cl.[7] ..... H01R 12/24; H01R 4/66; H01R 13/648

(52) U.S. Cl. ..... 439/498; 439/98

(58) Field of Search ..... 439/498, 494, 439/495, 496, 499, 607, 98

(56) References Cited

U.S. PATENT DOCUMENTS

| | | | | | |
|---|---|---|---|---|---|
| 5,085,596 | A | * | 2/1992 | Bowen et al. | 439/497 |
| 5,138,678 | A | | 8/1992 | Briggs et al. | 385/86 |
| 5,181,861 | A | * | 1/1993 | Gaver et al. | 439/578 |
| 2002/0002004 | A1 | * | 1/2002 | Akama et al. | 439/625 |

FOREIGN PATENT DOCUMENTS

| | | |
|---|---|---|
| JP | 5-224090 | 9/1993 |
| JP | 9-042538 | 2/1997 |
| JP | 9-080260 | 3/1997 |
| JP | 9-325249 | 12/1997 |

* cited by examiner

*Primary Examiner*—Brian Sircus
*Assistant Examiner*—Chandrika Prasad
(74) *Attorney, Agent, or Firm*—Staas & Halsey LLP

(57) ABSTRACT

A cable connector includes a cable including a conductor, a contact connected to a tip part of the conductor, and a connector connected to the cable. The connector includes a terminal part including an insulator having a hole formed therein. The contact is pressed into the hole.

21 Claims, 11 Drawing Sheets

CABLE CONNECTOR HAVING GOOD SIGNAL TRANSMISSION CHARACTERISTIC

BACKGROUND OF THE INVENTION

1. Field of the Invention

The present invention generally relates to cable connectors, and more particularly to a cable connector for connecting electronic devices.

2. Description of the Related Art

The recent development in electronic technology has increased the amount of signals exchanged between remote electronic devices and realized a higher-speed transmission of signals. This inevitably requires cable connectors to be provided with an increased number of conductors, that is, to include thicker cables containing conductors.

On the other hand, however, there has been a strong demand for downsized cable connectors in response to the downsizing of electronic devices.

A description will now be given, with reference to FIGS. 1A through 2, of a conventional cable connector 1. FIGS. 1A and 1B are a fragmentary perspective view and a fragmentary side view of the cable connector 1, and FIG. 2 is a perspective view of a lower half part 9*a* of a housing 9 of the cable connector 1.

The cable connector 1 includes a terminal part 2, a wiring board 3 for connection, a cable 5 including a plurality of conductors 4, and the housing 9 containing these members. In FIG. 2, the upper half part of the housing 9 is not shown.

The terminal part 2 includes a resin insulator 6 and a plurality of terminals 7 provided in two rows in the insulator 6. The insulator 6 has a plurality of holes 6a formed therein in upper and lower two rows. Each terminal 7 has a first end part 7*a* formed into a straight linear shape and a second end part 7*b* formed into a tongue-like strip having a step-like-bent portion. Each terminal has the first end part 7*a* inserted into a corresponding one of the holes 6*a* of the insulator 6 to be used for connection with an electronic component, which is not shown in the drawings, and has the second end part 7*b* protruding in the rightward direction of FIG. 1B.

In this case, the wiring board 3 has a plurality of interconnection lines 8 formed only on its upper surface, and pads 8*a* and 8*b* are provided on the first and second end parts of each interconnection line, respectively.

A skin 5*a* of the cable 5 is cut so that the conductors 4 are exposed. The tip part of the exposed portion of each conductor 4 is stripped off a coating layer 5*b* so as to be a bare wire.

The second end part 7*b* of each terminal 7 and the tip part of each conductor 4 are positioned on and fixedly soldered to a predetermined one of the pads 8*a* and a predetermined one of the pads 8*b*, respectively.

The housing 9 is made of a metal material. An engagement part 9 shaped like a half-cut flange is formed on a side of the lower half part 9*a* shown in FIG. 2 from which side the cable 5 is inserted thereinto.

The terminal part 6, the wiring board 3, and the cable 5 are connected in the above-described manner to be contained in the housing 9. At this point, as shown in FIG. 2, an end part of the cable 5 which part has the conductors 4 exposed is placed on the engagement part 9, and a fastener 9*c* whose center portion is curved like an arc is screwed to the lower half part 9*b* from its upper side. As a result, the cable 5 is fixed to the lower half part 9*a* of the housing 9. Thereafter, by placing the upper half part (not shown) of the housing 9 on the lower half part 9*a*, the cable connector 1 having the conductors 4 of the cable 5 connected via the wiring board 3 to the corresponding terminals 7 is completed.

In the case of the above-described cable connector 1, all the conductors 4 are used for the same purpose, for instance, as signal lines. In other cases, two signal lines and one ground line may be grouped as conductors for balanced transmission to increase noise resistance. In such cases, the above-described wiring board 3, for instance, has interconnection lines formed also on its lower surface. Then, one of the two signal lines is connected to the upper surface of the wiring board 3 and the other to the lower surface thereof. Further, the ground line is provided next to either signal line.

However, the above-described conventional cable connector 1 requires the terminals 7 and the conductors 4 provided on first and second parallel ends of the wiring board 3, respectively, to be fixedly soldered one by one to the wiring board 3, thus making this connection operation complicated and troublesome. Further, soldered parts included in the conventional cable connector 1 may cause the distortion of signals especially in a cable for high-speed transmission, which is another disadvantage in terms of a signal transmission characteristic. Furthermore, the conventional cable connector 1 includes the wiring board 3, which is undesirable in terms of the signal transmission characteristic and also prevents the cable connector 1 from being downsized.

Further, the separated conductors 4 showing from the cable 5 should be positioned one by one on the pads 8*b* formed on the wiring board 3. This makes the connection operation complicated and troublesome, and may decrease accuracy in positioning.

Moreover, if an external force to rotationally move the cable 5 is exerted thereon, the above-described fixing method using the faster 9*c* cannot completely prevent the rotational movement of the cable 5. Thus, a force is exerted on the tip part of each conductor 4 so that each soldered tip part of the conductors 4 may come off the wiring board 3 or poor connections may be caused between the conductors 4 and the pads 8*b*.

SUMMARY OF THE INVENTION

It is a general object of the present invention to provide a cable connector in which the above-described disadvantages are eliminated.

A more specific object of the present invention is to provide a downsized cable connector that has a good signal transmission characteristic and has conductors positioned with good accuracy and contacted with terminals efficiently and easily in the production process of the cable connector.

Another more specific object of the present invention is to provide a cable connector that has a cable fixed reliably to a connector so that an external force generated to rotationally move the cable is prevented from being exerted on a part of the cable inside the connector.

The above objects of the present invention are achieved by a cable connector including: a cable including a conductor; a contact connected to a tip part of the conductor; and a connector connected to the cable, the connector including a terminal part including an insulator having a hole formed therein, wherein the contact is pressed into the hole.

The above-described cable connector includes neither soldered parts nor a wiring board for connecting terminals and conductors. This is desirable in terms of a signal transmission characteristic and also allows the cable connector to be free of the poor connections of soldered parts. Further, the cable connector can be produced efficiently and easily, and be downsized by the size of a wiring board.

Additionally, the connector may include an arrangement member for arranging said cable.

Thereby, the cable can be positioned with good accuracy in the fabrication process of the cable connector. Further, even if the connector is connected to a plurality of cables, the cable connector can be produced efficiently and easily by pressing a plurality of contacts into corresponding holes at one time by using a jig.

The above objects of the present invention are also achieved by a cable connector including: a balanced cable including a pair of signal lines and a ground line; a plurality of contacts connected to tip parts of the signal lines; and a connector connected to the cable, the connector including: a terminal part including an insulator having a plurality of holes formed therein, and a plurality of ground contacts penetrating the insulator; and an arrangement member which arranges the cable, wherein each of the contacts is pressed into a corresponding one of the holes, and the ground line is electrically connected via the arrangement part to the ground contacts.

This cable connector also produces the above-described effects of the present invention, and has a good signal transmission characteristic especially at a time of balanced transmission.

Additionally, the arrangement member, the terminal part, the contacts and the cable may be fixedly integrated with one another.

Thereby, an external force is prevented from being exerted on the connections of the conductors and the contacts, imposing no load thereon.

The above objects of the present invention are also achieved by a cable connector including: a cable; a connector including a cover member having a hole formed in a sidewall thereof; and a hollow flexible member for binding and caulking the cable, the hollow flexible member being fitted into the hole, wherein the cable is inserted into the hollow flexible member to be bound and caulked thereby so that an end part of the cable protrudes from the hollow flexible member to be connected to a terminal of the connector.

The above-described cable connector has the cable fixed reliably to the connector. Therefore, even if an external force is exerted to rotationally move the cable, the external force is prevented from being exerted on the part of the cable contained inside the connector. Thus, the above-described cable connector is free of the poor electrical connection of the cable and the connector.

The above objects of the present invention are further achieved by a cable connector including: a plurality of cables; a connector including a cover member having holes formed in a sidewall thereof; and a plurality of hollow flexible members each for binding and caulking a corresponding one of the cables, the hollow flexible members each being fitted into a corresponding one of the holes, wherein each of the cables is inserted into a corresponding one of the hollow flexible members to be bound and caulked thereby so that an end part of each of the cables protrudes from the corresponding one of the hollow flexible members to be connected to a terminal of the connector.

This cable connector is also free of the poor electrical connections of the cables and the connectors for the above-described reason.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

A description will now be given, with reference to the accompanying drawings, of embodiments of the present invention.

A description will first be given, with reference to FIGS. 3 through 7, of a cable connector 10 according to a first embodiment of the present invention.

Figure 1A:
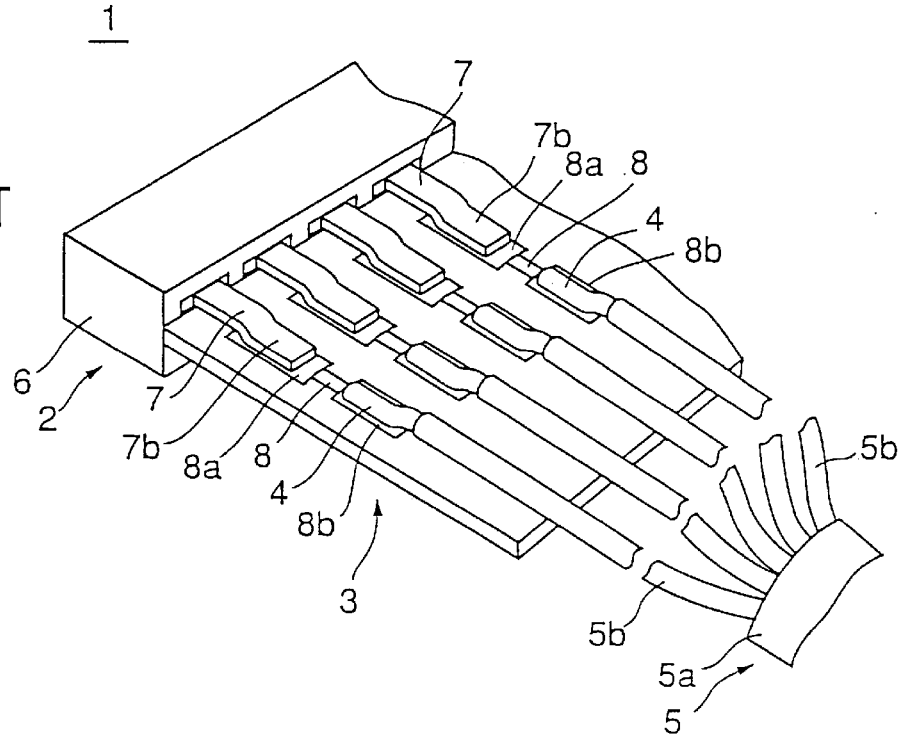
FIG. 1A PRIOR ART
FIGS. 1A and 1B are a fragmentary perspective view and a fragmentary side view of a conventional cable connector.
Figure 1B:
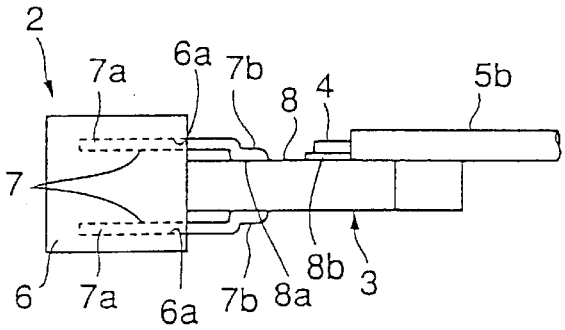
FIG. 1B PRIOR ART
Figure 2:
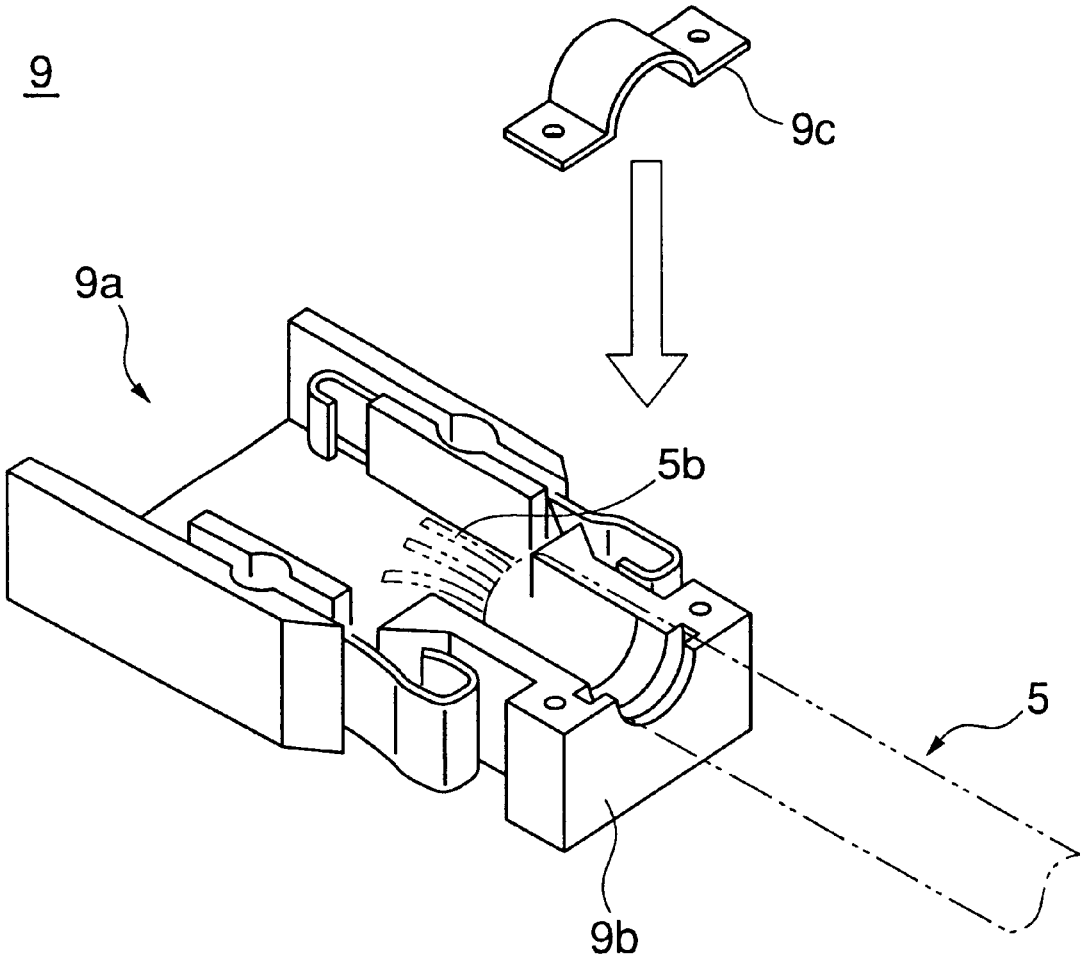
FIG. 2 PRIOR ART
FIG. 2 is a perspective view of a lower half part of a housing of the conventional cable connector.
Figure 3:
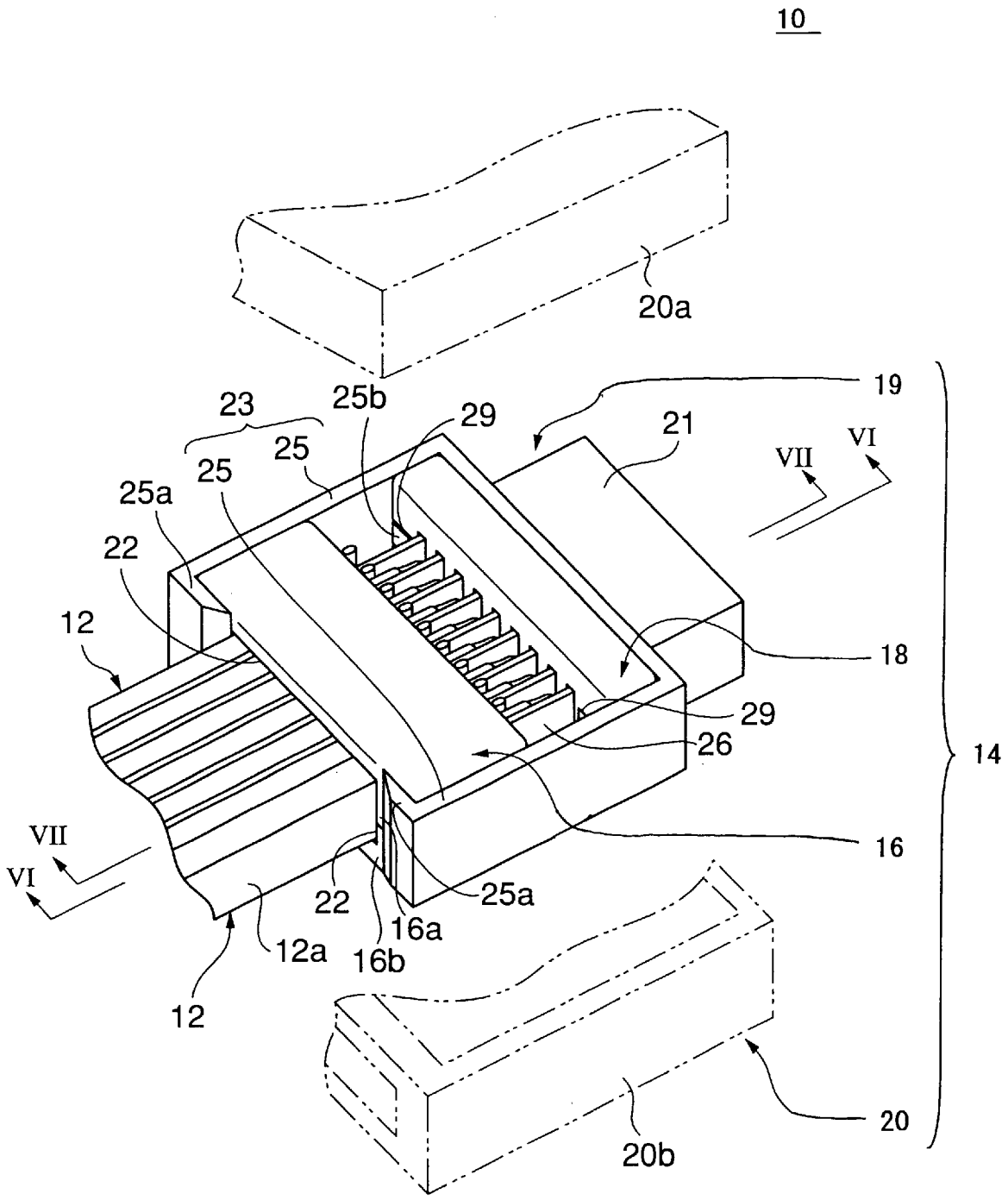
FIG. 3 is a perspective view of a cable connector without a housing according to a first embodiment of the present invention.
Figure 4:
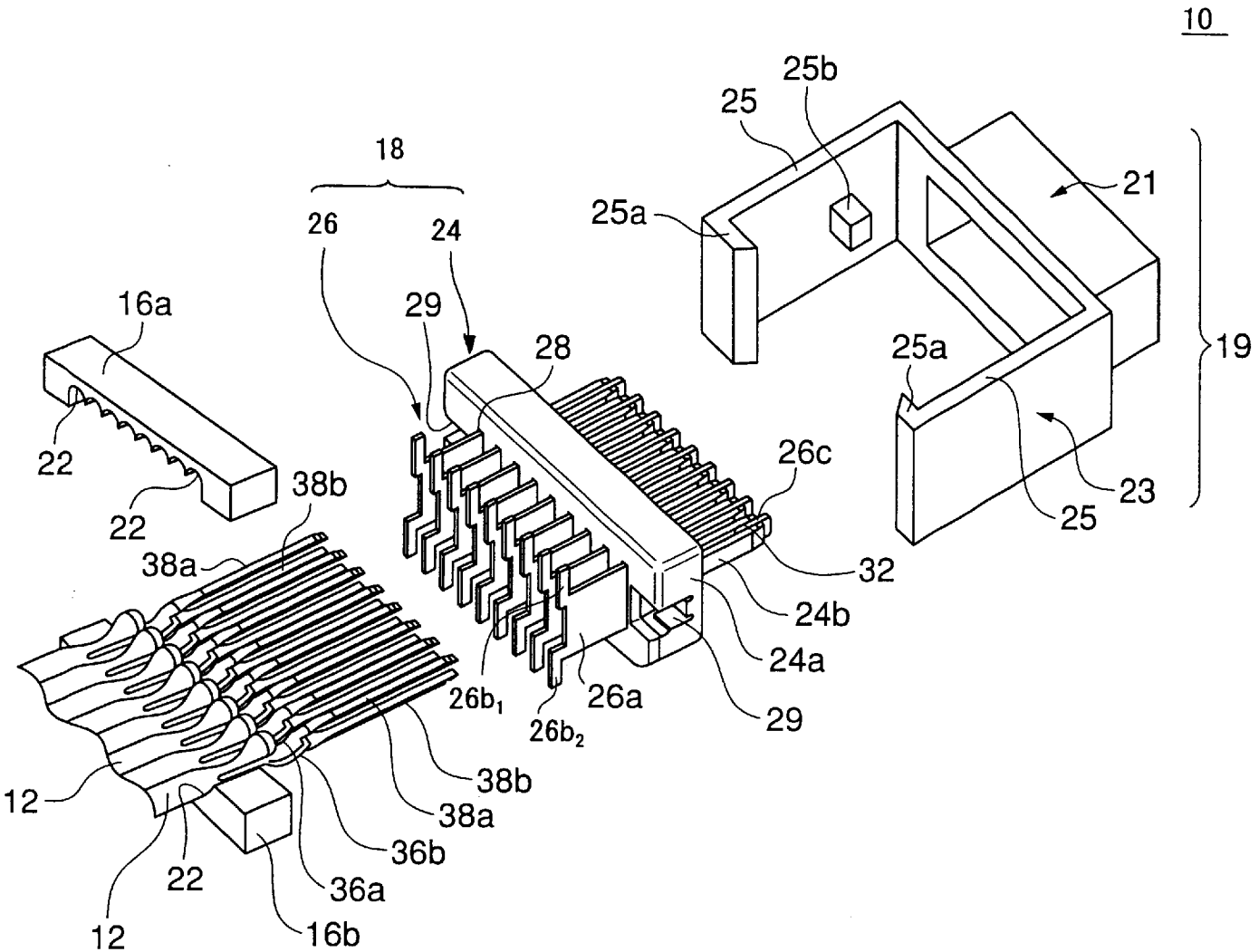
FIG. 4 is an exploded perspective view of the cable connector of FIG. 3.
Figure 5:
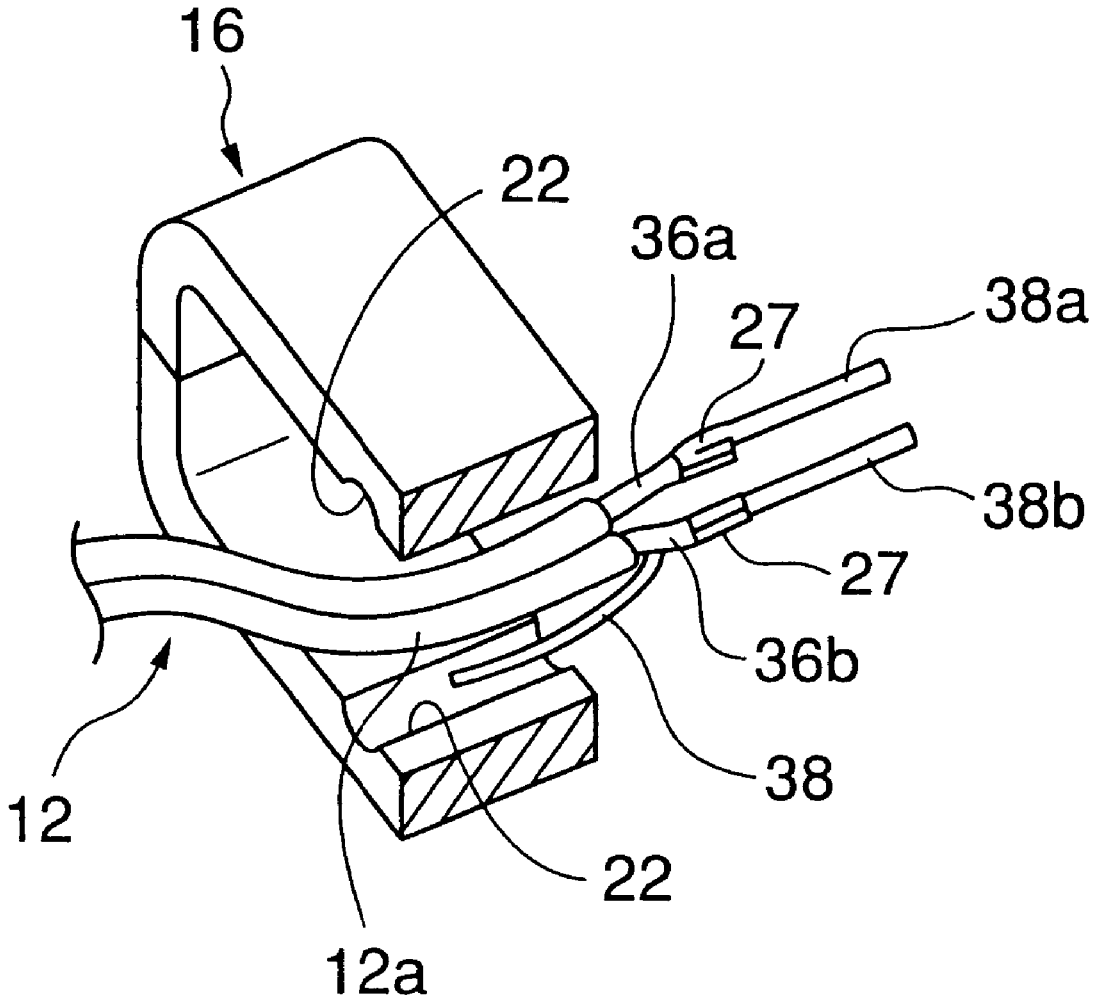
FIG. 5 is enlarged fragmentary views of a cable and an arrangement member of the cable connector of FIG. 3.
Figure 6:
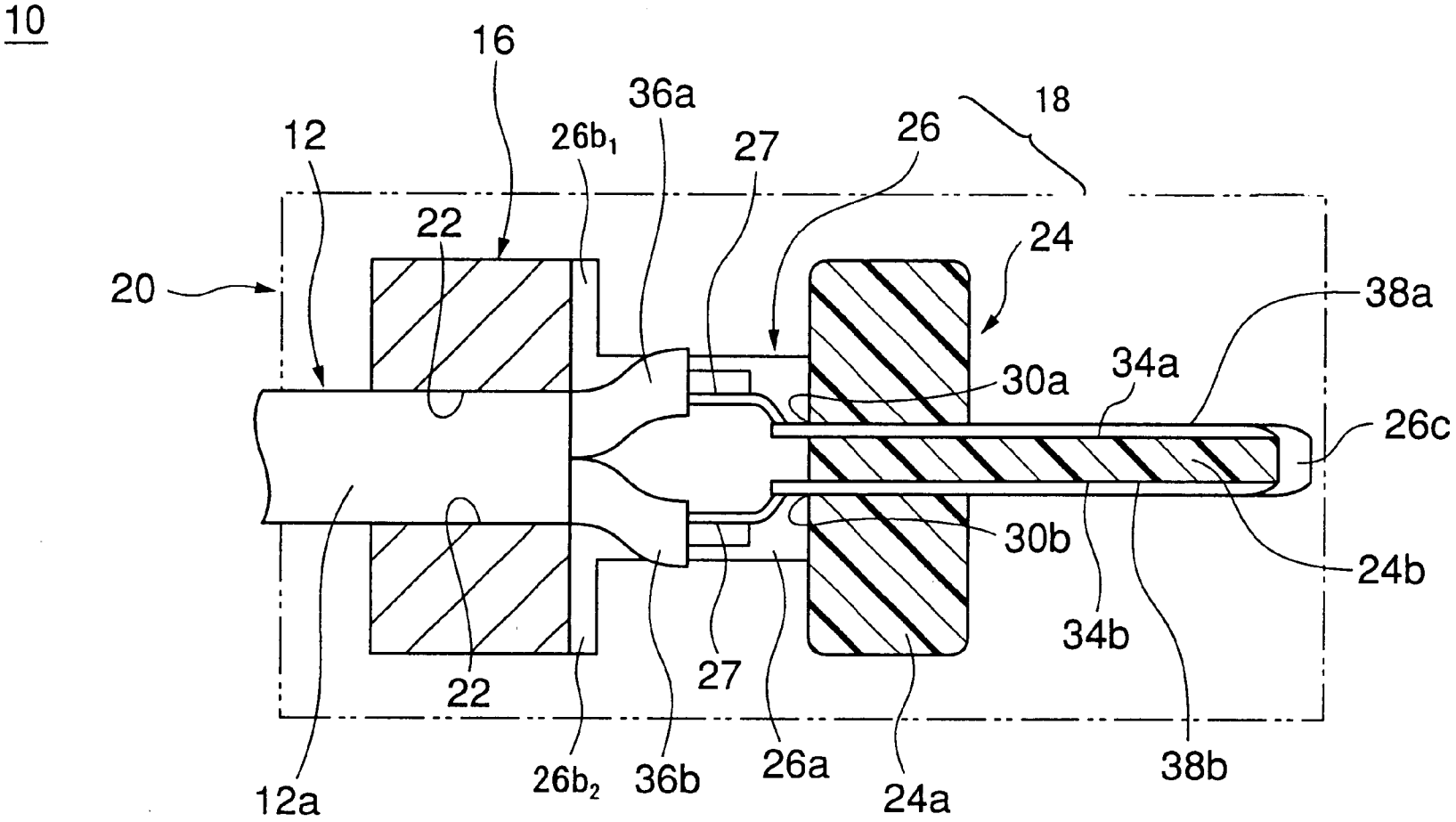
FIG. 6 is a sectional view of the cable connector of FIG. 3 taken along the line VI—VI.
Figure 7:
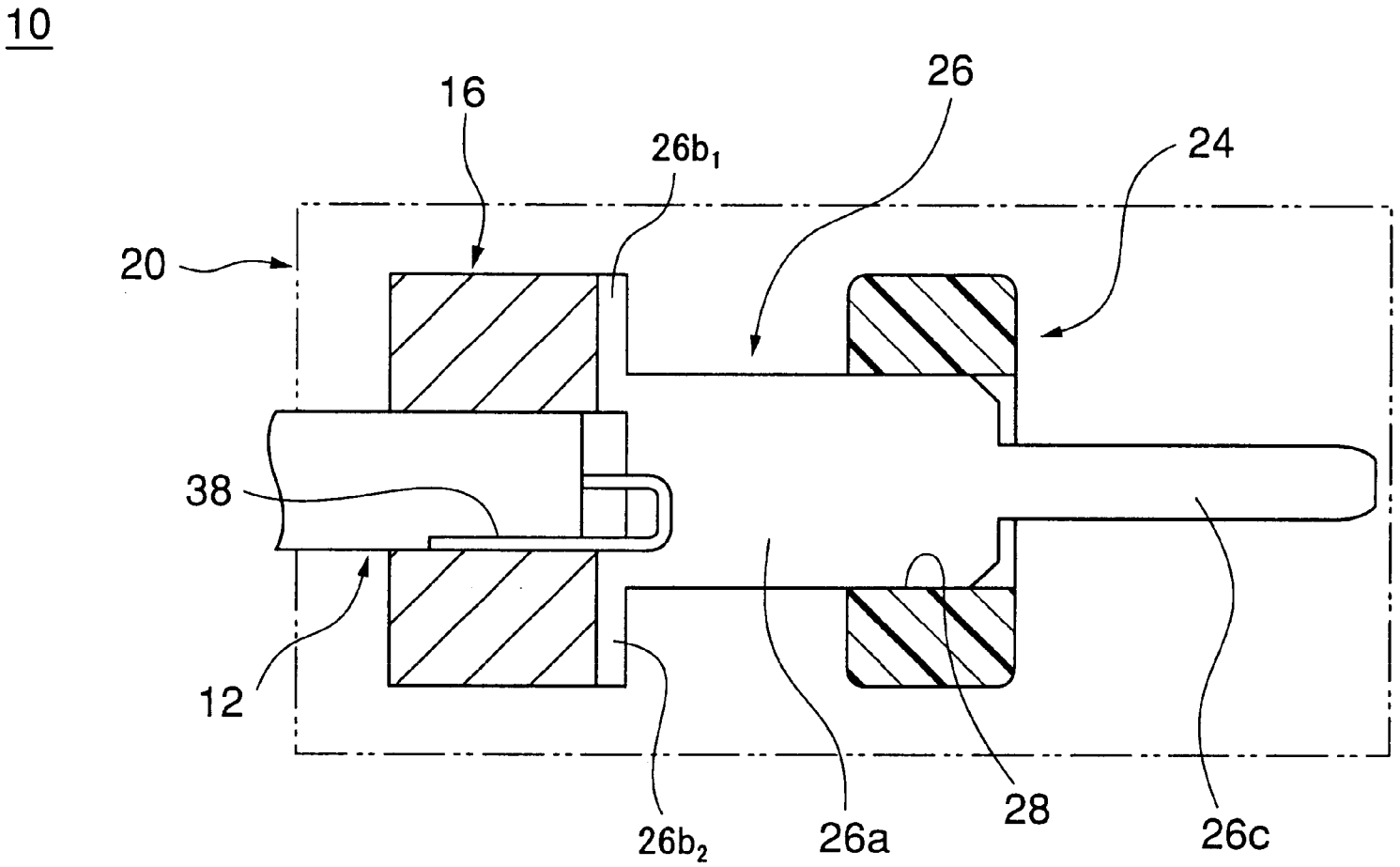
FIG. 7 is a sectional view of the cable connector of FIG. 3 taken along the line VII—VII.

FIG. 3 is a perspective view of the cable connector 10 without a housing 20. FIG. 4 is an exploded perspective view of the cable connector 10 of FIG. 3. FIG. 5 is enlarged fragmentary views of one of a plurality of cables 12 and an arrangement member 16. FIG. 6 is a sectional view of the cable connector 10 of FIG. 3 taken along the line VI—VI. FIG. 7 is a sectional view of the cable connector 10 of FIG. 3 taken along the line VII—VII.

The cable connector 10 includes a connector 14 and the cables 12 connected thereto.

The connector 14 includes the arrangement member 16, a terminal part 18, a coupling member 19, and the housing 20 formed of upper and lower half parts 20*a* and 20*b*.

The arrangement part 16, which is provided for arranging the cables 12, is defined by upper and lower half parts 16*a* and 16*b* each formed of a conductive metal material. A plurality of grooves 22 each having a shape corresponding to an outer shape of each cable 12 are formed in each of the upper and lower half parts 16*a* and 16*b*.

The terminal part 18 is provided for electrically connecting the later-described conductors of the cables 12 and the terminals of a connector (not shown) for an electronic device which connector is to be connected to the connector 14. The terminal part 18 is defined by a main body 24 and ground contacts 26 arranged side by side along the length of the main body 24 to penetrate the main body 24 as shown in FIG. 4.

As shown in FIG. 4, the main body 24 includes a rectangular parallelepiped part 24*a* formed of an insulating resin material and a thin plate part 24*b* protruding therefrom. The thin plate part 24*b* is provided along a longitudinal centerline of a side of the rectangular parallelepiped part 24*a*. A plurality of vertical slits 28 are formed at equal intervals in the rectangular parallelepiped part 24*a*. A hole 30*a* and a hole 30*b* are formed in vertically spaced positions in a resin part between each two slits 28. A concave part 29 is formed in each of the longitudinal end side portions of the rectangular parallelepiped part 24*a*. A plurality of slits 32 communicating with the corresponding slits 28 are formed in the thin plate part 24*b*. Each slit 32 has upper and lower openings. Shallow grooves 34*a* and 34*b* are formed in a resin part between each two slits 32 so as to communicate with a corresponding one of the holes 30*a* and a corresponding one of the holes 30*b*, respectively.

Each ground contact 26, which is made of a conductive metal material, includes a flat-plate-like main part 26*a* having first and second parallel ends. The main part 26*a* has first and second protrusion parts 26*b*1 and 26*b*2 protruding from its first end in the upper and lower directions of FIG. 4, respectively. The main part 26*a* further has a vertically narrow contact part 26*c* formed on its second end so as to protrude therefrom.

Each ground contact 26 is pressed into a corresponding one of the slits 28 and a corresponding one of the slits 32. Thereby, the main body 24 and the ground contacts 26 are integrated into the terminal part 18.

The coupling part 19 includes a containing part 21 and a grip part 23 each formed of an insulating resin material. The containing part 21 is formed to be a hollow rectangular parallelepiped. The grip part 23 is provided to protrude from the containing part 21. The grip part 23 includes two opposed arms 25 each having a claw part 25*a* formed on its tip part. A projection 25*b* is formed on the inner face of each arm 25. In FIG. 4, only one of the projections 25*b* is shown.

Each cable 12, which is a balanced cable, has two signal lines 36*a* and 36*b* that are conductors and a ground line 38 that is a conductor. Each cable 12 is used with the tip part of each of the signal lines 36*a* and 36*b* and the ground line 38 being stripped of coating layers 12 so as to be exposed. End parts of substantially stick-like contacts 38*a* and 38*b* are fastened tightly by caulking to the tip parts of the signal lines 36*a* and 36*b*, respectively. The caulked parts are referred to by the numeral 27 in FIGS. 5 and 6.

A description will now be given of an assembling procedure of the cable connector 10.

The cables 12 are arranged with their end portions having the coating layers 12*a* placed on the grooves 22 of the lower half part 16*b* of the arrangement member 16. At this time, the tip part of each ground line 38 is bent in a U shape so as to be interposed between the outer skin, or the coating layer 12*a*, of the cable 12 and the groove 22 of the arrangement member 16 as shown in FIGS. 5 and 7. Then, the upper half part 16*a* is placed on the lower half part 16*b* to be fixed thereto by a fixation means (not shown). Thereby, the cables 12 are integrated with the arrangement member 16 in an arranged state. The tip parts of the ground lines 38 closely contact the arrangement member 16.

Next, with the contacts 38*a* and 38*b* connected respectively to the signal lines 36*a* and 36*b* of the cables 12 in the arranged state being vertically separated, by employing a jig (not shown), the contacts 38*a* and 38*b* are pressed and inserted into the corresponding holes 30*a* and 30*b* of the rectangular parallelepiped part 24*a* of the main body 24, respectively, and the tip parts of the contacts 38*a* and 38*b* are disposed in the grooves 34*a* and 34*b* of the thin plate part 24*b*, respectively. Thereby, the cables 12, the arrangement member 16, and the terminal part 18 are integrated. Further, at this point, the first and second protrusion parts 26*b*1 and 26*b*2 contact the arrangement member 16. Thereby, the ground lines are electrically connected via the arrangement member 16 to the ground contacts 26.

Next, with the thin plate part 24*b* being contained in the containing part 21, the arrangement member 16 and the terminal part 18 to which the cables 12 are fixed are gripped by the two arms 25 of the grip part 23. At this point, by inserting the projections 25*b* into the concave parts 29 of the rectangular parallelepiped part 24*a*, and by engaging the arrangement part 16 with the claw parts 25*a*, the cables 12, the arrangement member 16, and the terminal member 18 are fixedly integrated with one another.

Finally, by combining the upper and lower half parts 20*a* and 20*b* and fixing the upper and lower half parts 20*a* and 20*b* by a fixation member (not shown), the cable connector 10 is completed.

The cable connector 10 according to the first embodiment of the present invention includes neither soldered parts nor a wiring board for connecting terminals. This is desirable in terms of a signal transmission characteristic and also allows the cable connector 10 to be free of the poor connections of soldered parts. Further, the cable connector 10 can be produced efficiently and easily, and be downsized by the size of a wiring board.

Since the cable connector 10 includes the arrangement member 16 for arranging the cables 12, the cables 12 can be positioned with good accuracy in the fabrication process of the cable connector 10. Further, since the contacts 38*a* and 38*b* are pressed into the holes 30*a* and 30*b* at one time by using the jig, the cable connector 10 can be produced efficiently and easily.

Further, the cable connector 10 has a good signal transmission characteristic especially at a time of balanced transmission as a cable connector having the connector 14 including the terminal part 18 to be connected to an electronic component connected to at least one of the balanced cables 12 each including a plurality of conductors that are the two signal lines 36*a* and 36*b* and the ground line 38 as a group.

Furthermore, the cable connector 10 has the tip part of the ground line 38 of each cable 12 bent in a U shape to be interposed between the outer skin of each cable 12 and the arrangement member 16. Therefore, the ground lines 38 can be electrically connected to the connector 14 in a simple and easy manner.

Moreover, the cable connector 10 has the cables 12, the arrangement member 16, and the terminal member 18 fixedly integrated with one another by the coupling member 19. Therefore, even if an external force is exerted on the connections of the signal lines 36*a* and 36*b* and the contacts 38*a* and 38*b* so that a load is imposed thereon, the cable connector 10 is prevented from having poor connections caused therein. In addition, it is reliable that the ground lines 38 are electrically connected via the arrangement member 16 to the ground contacts 26.

Next, a description will be given, with reference to FIG. 8, of a cable connector 40 that is a variation of the cable connector 10 of the first embodiment.

Figure 8:
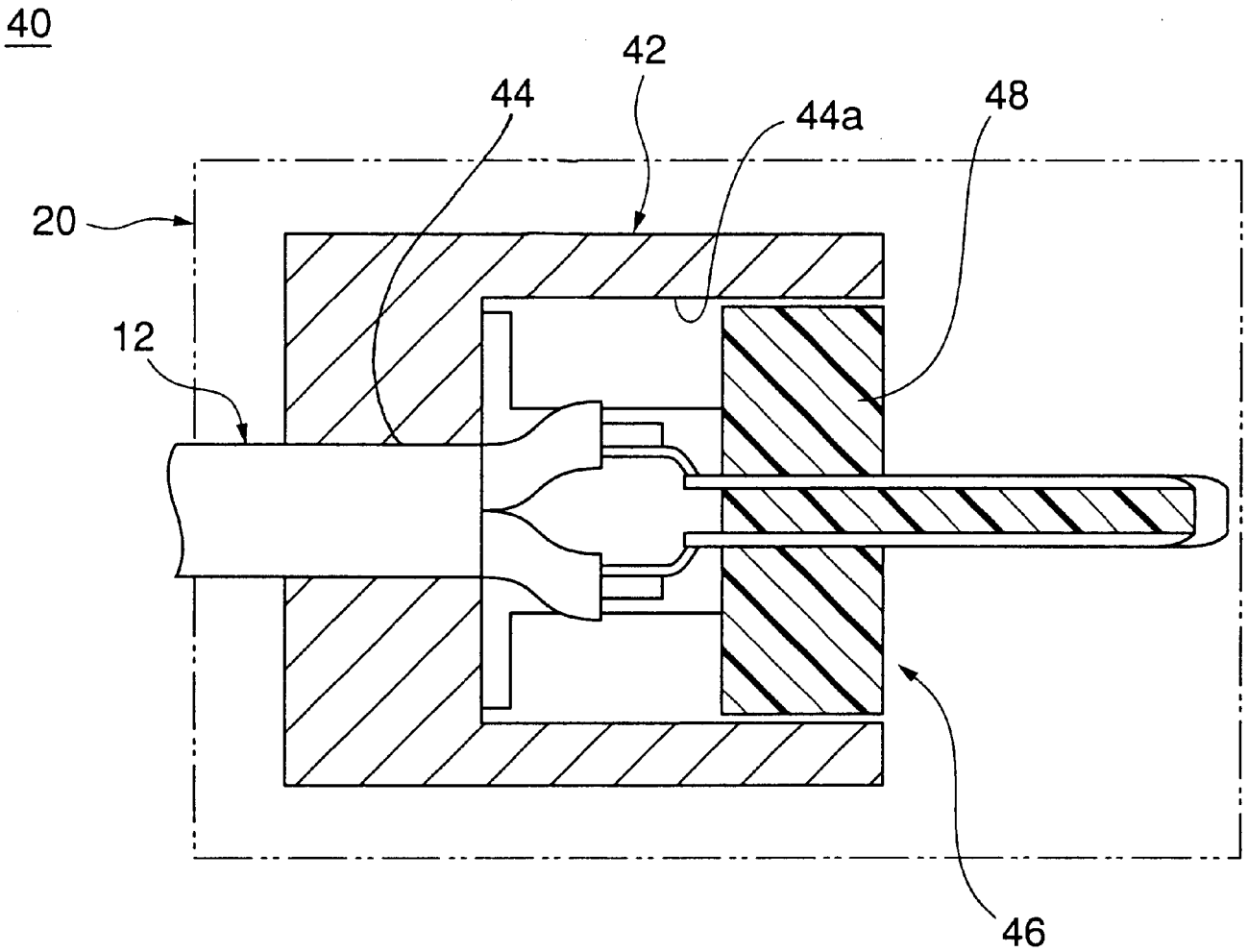
FIG. 8 is a sectional view of a cable connector that is a variation of the cable connector of FIG. 3.

The cable connector 40 shown in FIG. 8 has the same basic structure as the cable connector 10. Therefore, a description of the basic structure of the cable connector 40 will be omitted.

The cable connector 40 differs from the cable connector 10 in that an enlarged groove part 44*a* communicating with grooves 44 is formed in an arrangement member 42 so that a main body 48 of a terminal part 46 is fitted into the enlarged groove part 44*a* to be fixedly integrated with the cables 12 by the arrangement member 42.

Thereby, even if an external force is exerted on the connections of the signal lines 36*a* and 36*b* and the contacts 38*a* and 38*b* so that a load is imposed thereon, the cable connector 40, like the cable connector 10, is prevented from having poor connections caused therein.

Next, a description will be given, with reference to FIGS. 9 through 11, of a cable connector 50 according to a second embodiment of the present invention.

Figure 9:
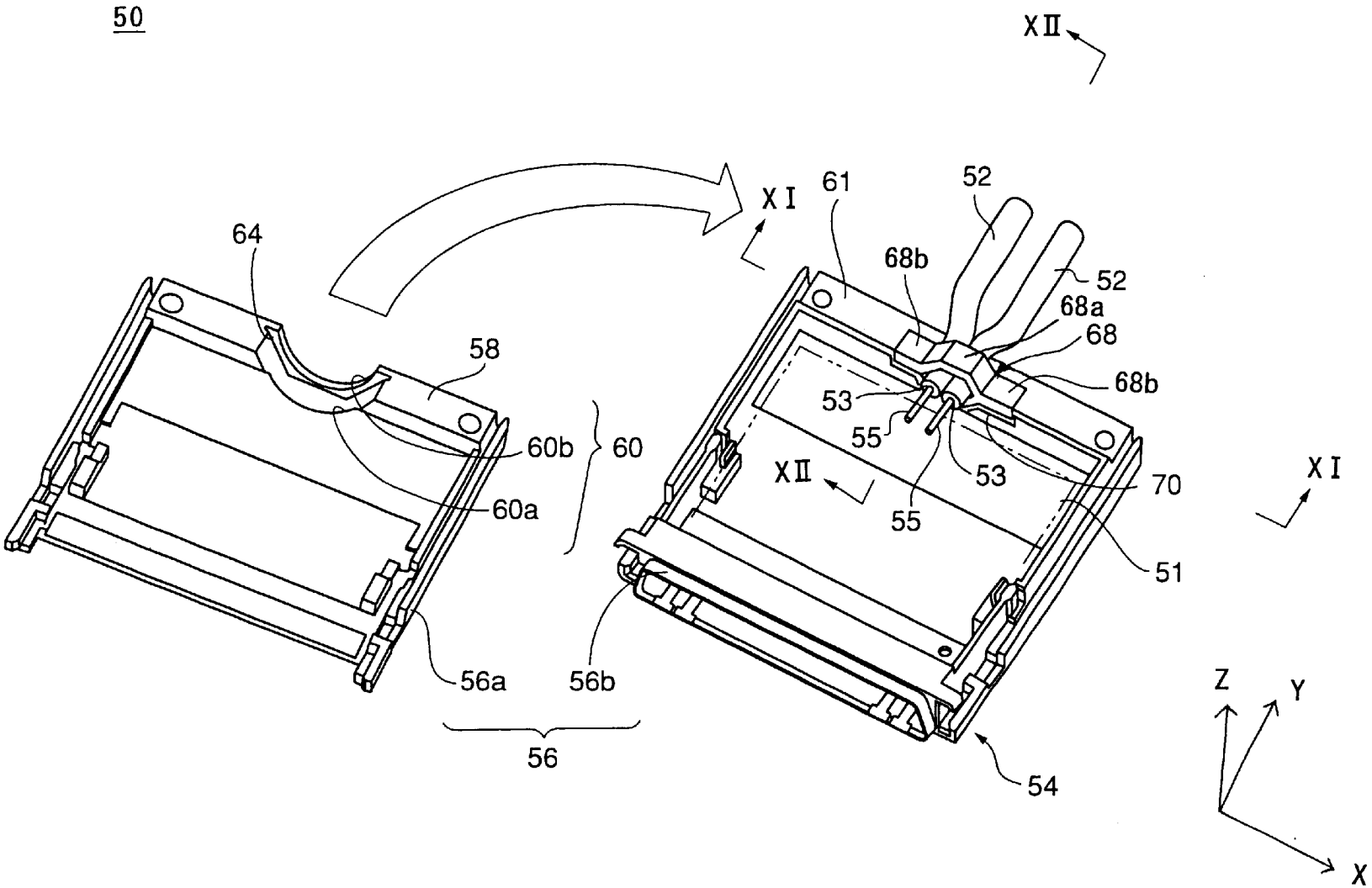
FIG. 9 is a schematic perspective view of a cable connector according to a second embodiment of the present invention with an upper half part of a housing of the cable connector being detached from a lower half part thereof.

FIG. 9 is a schematic perspective view of the cable connector 50 with an upper half part 56*a* of a housing 56 being detached from a lower half part 56*b* thereof. FIG. 10 is a sectional view of the cable connector 50 of FIG. 9 taken along the line XI—XI. FIG. 11 is a sectional view of the cable connector 50 of FIG. 9 taken along the line XII—XII.

The cable connector 50 includes a connector 54 and a plurality of cables 52 connected thereto.

The connector 54 includes a main body 51 that electrically connects the cables 52 and the connector of an electronic device (not shown). The main body 51, whose detailed structure is not shown in the drawings, may be the connector 14 of the cable connector 10 of the first embodiment, or the connector, that is, the terminal part 2, the wiring board 3, and the housing 9, of the conventional cable connector 1.

The connector 54 also includes a housing 56 shown in FIG. 9. The housing 56 is defined by upper and lower half parts 56*a* and 56*b* each made of a conductive metal. In this case, the housing 56 serves as a shield member.

As shown in FIG. 9, the cables 52 are coaxial cables, for instance. Each cable 52 contains a center conductor 55 and an outer conductor 53*a* made of woven strands of a conductive metal that are separated by an insulating layer (not shown). The outer conductor 53*a* is covered with a plurality of coating layers 53. The tip part of each cable 52 is stripped of the coating layers 53 so that the center conductor 55 is exposed. These cables 52 are connected to the connector 54 as described above.

Next, a description will be given structurally of connection between the cables 52 and the connector 54.

The upper half part 56*a* of the housing 56 has a stepped groove part 60 formed in a sidewall 58 thereof. The sidewall 58 is provided on a side from which the cables 52 are connected to the connector 54. As shown in FIGS. 9 and 10, the groove part 60 includes a large-diameter groove 60*a* having a trapezoidal sectional shape in the X direction and a U-shaped small-diameter groove 60*b* communicating with the large-diameter groove 60*a*, so that a flange part 64 defining the small-diameter groove 60*b* is formed along the inner surface of the groove part 60. On the other hand, in correspondence to the upper half part 56*a*, the lower half part 56*b* has a stepped groove part 62 formed in a sidewall 61 thereof. The sidewall 61 is provided on the side from which the cables 52 are connected to the connector 54. The groove part 62 includes a large-diameter groove 62*a* whose sectional shape in the X direction is a combination of a trapezoid and a rectangle and a U-shaped small-diameter groove 62*b* communicating with the large-diameter groove 62*a*, so that a flange part 66 defining the small-diameter groove 62*b* is formed along the inner surface of the groove part 62. As shown in FIG. 10, the groove part 60 has an opening facing the downward direction of FIG. 10 and the groove part 62 has an opening facing the upward direction of FIG. 10.

A flexible caulking member 68 made of a conductive metal, for instance, is provided to bind and caulk the end parts of the cables 52. The caulking member 68 includes a hollow cylindrical part 68*a* and two flange-like protrusion parts 68*b* protruding in opposite directions from the outer surface of the cylindrical part 68*a*. The original shape of the caulking member 68 is not shown in the drawings.

Figure 11:
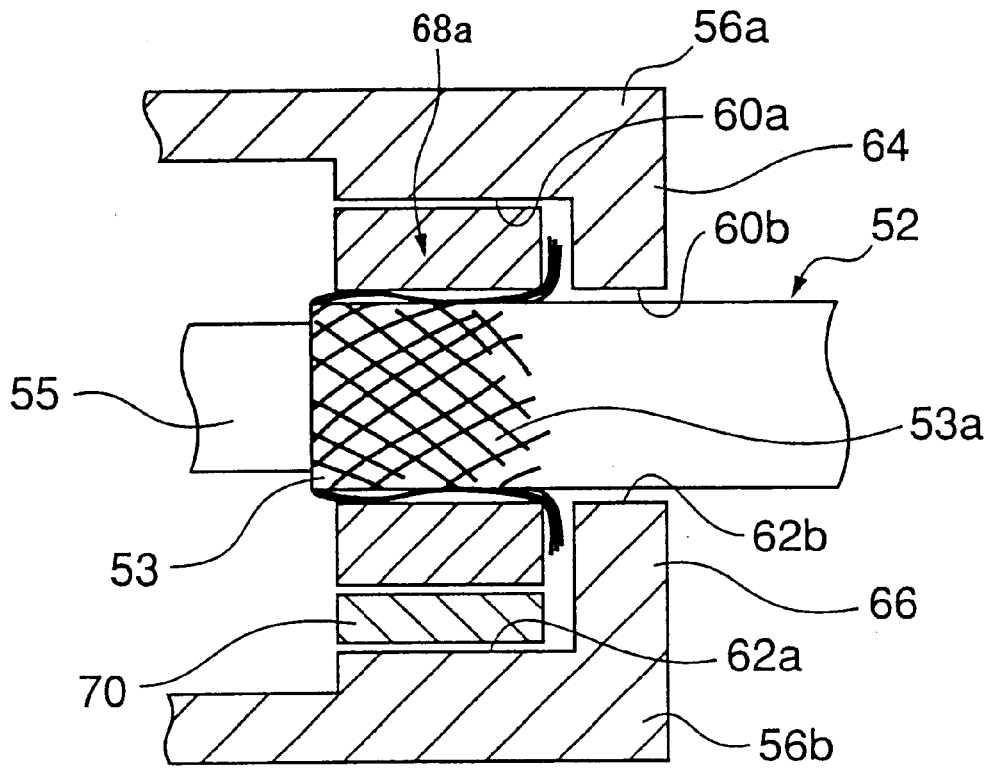
FIG. 11 is a sectional view of the cable connector of FIG. 9 taken along the line XII—XII.
Figure 11:
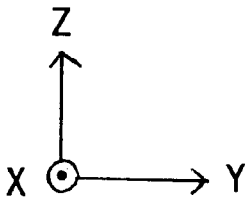

In order to connect the cables 52 having the exposed center conductors 55 to the connector 54, first, as shown in FIG. 11, by using a jig (not shown), each outer conductor 53*a* is peeled or folded back along the external skin of the cable 52, and the cables 52 are inserted into the caulking member 68 so that parts of the cables 52 to be connected to the terminals (not shown) of the connector 54 protrude from the caulking member 68. Then, the caulking member 68 binds and caulks the cables 52 with the outer conductors 53*a* being interposed between the caulking member 68 and the cables 52. Thereby, the cylindrical part 68*a* of the caulking member 68 deforms to have a hollow prism-like shape in the X direction. In this embodiment, the deformed shape of the cylindrical part 68*a* is a substantially hexagonal prism internally and externally. In other words, the outline of the sectional shape of the cylinder-like part 68*a* taken along the X-Z plane is substantially hexagonal externally and internally. Hereinafter, the deformed cylindrical part 68*a* may be referred to as a caulking part by the same numeral 68*a*. The protrusion parts 68*b* protrude in the opposite directions from the surface of the caulking part 68*a*.

Then, a leaf-spring-like spring member 70 made of a conductive metal and bent to have a substantially angular C shape is provided in the large-diameter groove 62*a* of the lower half part 56*b* of the housing 56. Next, the caulking part 68*a* is placed on the spring member 70. At this point, an excess part of each outer conductor 53*a* is further folded along the exterior of the caulking part 68*a* so as not to protrude from the housing 56. A part of each cable 52 around the caulking part 68*a* is placed in the small-diameter groove 62*b*. Then, the caulking part 68*a* is covered with the upper half part 56*a*, and the upper and lower half parts 56*a* and 56*b* are fixedly combined by a fastener (not shown).

Figure 10:
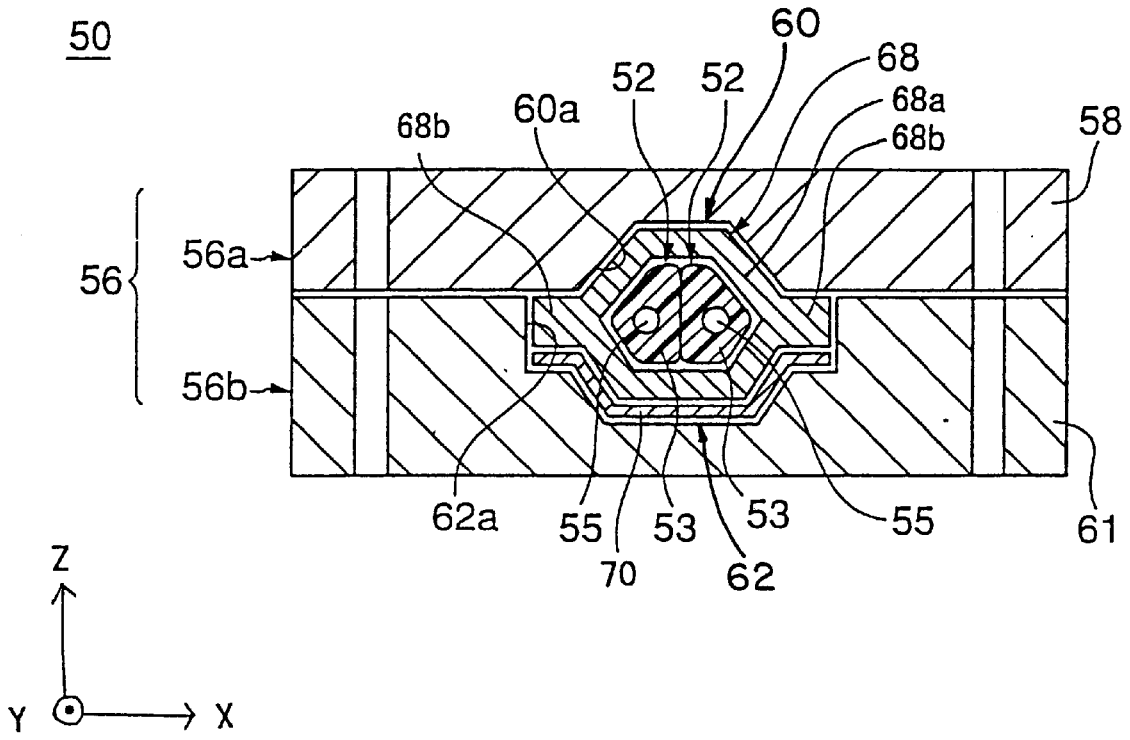
FIG. 10 is a sectional view of the cable connector of FIG. 9 taken along the line XI—XI.

At this point, as shown in FIG. 10, the large-diameter grooves 60*a* and 62*a* of the upper and lower half parts 56*a* and 56*b*, respectively, form a hole that has a substantially hexagonal sectional shape along the X-Z plane and has flange-like spaces formed in opposed positions inside the hole. The hole is designed so that its hexagonal sectional shape has a size slightly larger than that of the caulking part 68*a*. Therefore, the caulking part 68*a* is placed in the hole in close contact therewith since the hole is formed to have the same shape as the external shape of the caulking part 68*a*.

Further, by fixedly combining the upper and lower half parts 56*a* and 56*b* by tightening the fastener, the spring member 70 is deflected to generate a resilient force as bouncing force. Consequently, a pressing force is exerted to press the caulking part 68*a* against the large-diameter groove 60*a* of the upper half part 56*a* so that the caulking part 68*a* and the spring member 70 reliably come into close contact with the housing 56. Further, each outer conductor

53*a* is interposed between the cable 52 and the caulking part 68*a* to come into close contact with the caulking part 68*a* by the resilient force of the spring member 70.

The above-described cable connector 50 of the second embodiment has the caulking part 68*a* having the non-cylindrical shape, that is, the hollow hexagonal-prism-like external shape, placed in the hole formed by the large-diameter groove parts 60*a* and 62*a* to have the same shape as the external shape of the caulking part 68*a*. Therefore, even if an external force is exerted to rotationally move the cables 52, the caulking part 68*a* and the cables 52 caulked thereby are prevented from being rotationally moved. This prevents an external force from being exerted on the parts of the cables 52 contained inside the connector 54 to cause poor electrical connections of the cables 52 and the connector 54.

Further, the cable connector 50 has the protrusion parts 68*b* on the outer surface of the caulking part 68*a*, thus preventing the rotational movement of the caulking part 68*a* with more reliability.

Furthermore, the cable connector 50 has the caulking part 68*a* pressed by the spring member 70 to come into close contact with the large-diameter groove 60*a* of the upper half part 56*a*, thus preventing the rotational movement of the caulking part 68*a* with more reliability.

Moreover, the cable connector 50 has each outer conductor 53*a* connected electrically with more reliability via the caulking part 68*a* or the spring member 70 to the large-diameter grooves 60*a* and 62*a* of the housing 56, thus ensuring shielding effect.

The cable connector 50 has the caulking part 68*a* contact the flange parts 64 and 66 if an external force is exerted to pull the cables 52 out of the connector 54, thus preventing the cables 52 from being pulled out.

The present invention is not limited to the specifically disclosed embodiments, but variations and modifications may be made without departing from the scope of the present invention.

The present application is based on Japanese priority application No. 2000-398529 filed on Dec. 27, 2000, the entire contents of which are hereby incorporated by reference.

What is claimed is:

1. A cable connector comprising:

a cable including a conductor;

a conductor contact connected to a tip part of the conductor; and a connector connected to said cable, the connector including a terminal part including an insulator having a hole formed therein, and a ground contact provided on said terminal part so as to penetrate into said insulator, said contact being pressed into the hole, the connector further having an arrangement member for arranging said cable, said arrangement member being made of a conductive material and being connected to a ground line in said cable, and said arrangement member being in an abutting engagement with said ground contact.

2. The cable connector as claimed in claim 1, wherein said arrangement member, said terminal part, said contact and said cable are fixedly integrated with one another.

3. A cable connector, comprising:

a balanced cable including a pair of signal lines and a ground line;

a plurality of signal contacts connected to tip parts of the signal lines; and a connector connected to said cable, the connector including a terminal part having, an insulator having a plurality of holes formed therein, a plurality of ground contacts penetrating said insulator; and an arrangement member which arranges said cable, wherein each of the signal contacts is pressed into a corresponding one of the holes; and the ground line is electrically connected via said arrangement part to said ground contacts, said arrangement member being made of a conductive material and said ground line is connected to said arrangement member, and said arrangement member being in an abutting engagement with said ground contacts.

4. The cable connector as claimed in claim 3, wherein the ground line has a tip part peeled back along an exterior of said cable so as to be interposed between said cable and said arrangement member.

5. The cable connector as claimed in claim 3, wherein said arrangement member, said terminal part, said contacts and said cable are fixedly integrated with one another.

6. The cable connector as claimed in claim 5, wherein said terminal part is fitted into said arrangement member.

7. The cable connector as claimed in claim 3, wherein each of said ground contacts penetrates said insulator to have first and second parts protruding from said insulator in first and second opposite directions, respectively.

8. The cable connector as claimed in claim 7, wherein said insulator comprises a thin plate part protruding in the first direction so that the first parts of said ground contacts penetrate corresponding slits formed in said plate part.

9. The cable connector as claimed in claim 7, wherein the second part of each of said ground contacts includes protrusion parts contacting said arrangement member.

10. The cable connector as claimed in claim 7, wherein said ground contacts are arranged side by side in a row.

11. A cable connector, comprising:

a cable;

a connector including a cover member having a hole formed in a sidewall thereof; and a hollow flexible member for binding and caulking said cable, the hollow flexible member being fitted into the hole, wherein said cable is inserted into said hollow flexible member and the hollow flexible member is deformed to bind and caulk the cable, so that an end part of said cable protrudes from the hollow flexible member to be connected to a terminal of said connector, said hollow flexible member is formed of a conductive material, and said hollow flexible member is connected electrically to a ground line in said cable.

12. The cable connector as claimed in claim 11, wherein:

said hollow flexible member originally has a hollow cylindrical shape and deforms to bind and caulk said cable; and the hole of the cover member of said connector is formed to have the same shape as a deformed shape of said hollow flexible member.

13. The cable connector as claimed in claim 12, wherein the deformed shape of said hollow flexible member is substantially a prism.

14. The cable connector as claimed in claim 11, wherein said hollow flexible member further comprises a protrusion part formed on an external surface of said hollow flexible member.

15. The cable connector as claimed in claim 11, further comprising a spring member interposed between said hollow flexible member and the hole of the cover member of said connector.

16. The cable connector as claimed in claim 15, wherein:

said cable is a coaxial cable including a center conductor and an outer conductor, the outer conductor having a tip part thereof folded back along an exterior of said cable to be interposed between said cable and said hollow flexible member; and said connector further comprises a shield member connected electrically to the outer conductor.

17. The cable connector as claimed in claim 16, wherein said shield member is electrically connected to the outer conductor via said hollow flexible member.

18. The cable connector as claimed in claim 16, wherein said shield member is electrically connected to the outer conductor via said spring member.

19. The cable connector as claimed in claim 18, wherein said spring member is made of a conductive material.

20. A cable connector, comprising:

a plurality of cables;

a connector including a cover member having holes formed in a sidewall thereof; and a plurality of hollow flexible members each for binding and caulking a corresponding one of said cables, the hollow flexible members each being fitted into a corresponding one of the holes, wherein each of said cables is inserted into a corresponding one of said hollow flexible members, and the hollow flexible member is deformed to bind and caulk the cable, so that an end part of each of said cables protrudes from the corresponding one of said hollow flexible members to be connected to a terminal of said connector, said hollow flexible member being formed of a conductive material, and a ground line of said cable being connected to said hollow flexible member.

21. The cable connector as claimed in claim 20, wherein:

each of said hollow flexible member originally has a hollow cylindrical shape and deforms to bind and caulk the corresponding one of said cables; and each of the holes of the cover member of said connector is formed to have the same shape as a deformed shape of a corresponding one of said hollow flexible members.

* * * * *